US005860439A

United States Patent [19]

Ostertag

[11] Patent Number: 5,860,439

[45] Date of Patent: Jan. 19, 1999

[54] WALKING AID

[76] Inventor: Karen Ostertag, Breitenlch 7, D-82335 Berg, F. R., Germany

[21] Appl. No.: 875,914

[22] PCT Filed: Jan. 31, 1996

[86] PCT No.: PCT/EP96/00403

§ 371 Date: Aug. 8, 1997

§ 102(e) Date: Aug. 8, 1997

[87] PCT Pub. No.: WO96/24322

PCT Pub. Date: Aug. 15, 1996

[30] Foreign Application Priority Data

Feb. 9, 1995 [DE] Germany ..... 295 02 136.5 U
Dec. 19, 1995 [DE] Germany ..... 195 47 484.8

[51] Int. Cl.[6] ..... A61H 3/02

[52] U.S. Cl. ..... 135/68; 135/71

[58] Field of Search ..... 135/71, 68, 73, 135/65, 69, 72, 75, 76

[56] References Cited

U.S. PATENT DOCUMENTS

| | | | |
|---|---|---|---|
| 2,388,778 | 11/1945 | Wheeler . | |
| 3,038,811 | 8/1962 | Gilmore | 135/71 |
| 3,157,187 | 11/1964 | Murcott | 135/68 |
| 4,787,405 | 11/1988 | Karwoski | 135/68 X |
| 4,869,280 | 9/1989 | Ewing | 135/71 X |
| 5,025,820 | 6/1991 | Gamper . | |
| 5,193,567 | 3/1993 | Razny, Jr. | 135/71 X |
| 5,318,058 | 6/1994 | Zimmerman | 135/68 |
| 5,329,954 | 7/1994 | Mioshi | 135/68 X |
| 5,331,989 | 7/1994 | Stephens | 135/71 X |
| 5,458,143 | 10/1995 | Herr | 135/68 |
| 5,495,867 | 3/1996 | Block | 135/73 X |
| 5,671,765 | 9/1997 | Haeberg, Jr. | 135/68 |

*Primary Examiner*—Lanna Mai
*Assistant Examiner*—Timothy B. Kang
*Attorney, Agent, or Firm*—Birch, Stewart, Kolasch & Birch, LLP

[57] ABSTRACT

A walking aid or crutch has a rod-shaped part (1), a grip (2) and a forearm support (3) or forearm region. The grip is connected at one end to the forearm support (3) and at the other end to the rod-shaped part (1). The walking aid may thus be substantially shaped out of a bent tube. This design of the walking aid places the supporting point of the walking aid further forward on the floor, giving the user a greater feeling of security and lengthening his steps.

19 Claims, 2 Drawing Sheets

WALKING AID

BACKGROUND OF THE INVENTION

The invention relates to a walking aid or crutch. Walking aids or crutches of this kind are used by persons hampered in walking temporarily or continually.

Known walking aids consist of a rod-shaped tube on which a grip and the bracket of the forearm support are mounted. The length of the rod-shaped tube is adjustable. On the bottom end of the pipe a so-called capsule having a walking surface of annular disk shape is provided. For the grip, a tube is welded to the rod-shaped body, which tube is required as a core for a plastic grip. A more common way is the solution of fixing a plastic member which includes a forearm sponge, a forearm support part as well as a perpendicularly protruding grip as a single-piece member on the walking tube. However, the steep angle of inclination of the forearm support part as well as the angle of the grip itself are not ergonomic. When putting a load on a slippery grip, the steep forearm support part pushes the encompassing hand forwardly in lever-like manner. The walking aid must be held actively so that after a short time, blisters will turn up on the hands. Furthermore older or weaker patients often cannot develop the required force and at premature times must use regular walking devices.

A further disadvantage lies in that by the commonly used construction of the forearm support part including the grip it is not possible to lay down, lean against or hang up the walking aids. This requires marketable hold members which, however, only are located in places intended therefor, like in doctor's practices, hospitals ambulances or the like. Because of the top-heaviness caused by the weight, of the construction, traditional crutches in addition tend to drop to the floor when leaned on. Many attempts are known for providing stableness to traditional crutches.

Moreover, two common walking aids cannot be held by the patient using one hand, as e.g. may be required for many actions of everyday demand, if one hand must be kept free for a short time; e.g. when climbing stairs, washing or similar activities.

Due to their construction they are not stackable either, for e.g. accommodating them in a car in room-saving and nevertheless ready-to-grip manner. Traditional crutches must be placed on the rear seats because of their tendency to slip away, this rendering more difficult access by a handicapped person.

SUMMARY OF THE INVENTION

It is the object of the present invention to create a walking aid or crutch which is of simple construction and ergonomically adapted to the demands of the user. Furthermore, it is to be made possible by a corresponding construction to avoid dropping and to permit staking the walking aid in a place-saving manner.

If the grip is located between the forearm support and the rod-shaped part, the walking aid can essentially be built from one continuous part. During walking, the rod-shaped part is located in front of the grip so that the point of contact with the floor is farther in front than in known walking aids. Thereby, the walking aid further reaches into the direction of walking and thus into the range of vision of the user thus giving a feeling of more safety, the patient further being able to safely position the crutches also on uneven paths. The person hampered in walking sees the ground onto which the walking aid is positioned. This reduces the danger of the walking aid slipping away because of unevennesses or holes. The advanced point of contact with the floor therein promotes an increased length of step. An increased length of step on one hand causes quicker propagation of the person hampered in walking and on the other hand provides the psychological advantage that the patient feels less decrepit and due thereto acts more safely.

In a constructionally simple embodiment of the present invention, the rod-shaped part, the grip and the forearm support are mutually connected by a continuous tube. Instead of connecting several parts with one another, the tube only has to be bent in accordance with the ergonomical demands. Furthermore, the grip is resiliently supported on the rod-shaped part so that an impactuous loading when placing the walking aid on the floor can be avoided to great extent.

In terms of ergonomy it is preferable that the grip is built essentially horizontally and the forearm support is build slightly inclined backwardly with respect to the horizon. Because of the almost horizontal embodiment of the grip the user can exert force of weight onto to the walking aid without problem. A slightly inclined walking aid permits better guiding of the forearm during walking, since the forearms of the user are slightly bent forwardly due to the advanced point of contact with the floor of the walking aid. This position permits the user an increased angle of rotation of the walking aid around the point of contact than could be realized in a vertically extending forearm support.

In a preferred embodiment of the present invention, the rod-shaped part is adjustable in length and the grip is made of a resilient material. If the resilient material is exchangeable, it can be optimally adapted to the respective user. The part of the tube which forms the grip therein is provided with a coating of hard or cellular rubber or a respectively deformable blunt plastic material with ergonomically formed grip flutes. The use of a possibly individual solution is left open depending on construction.

An optimal ergonomical adaptation to the person hampered in walking can further be effected by a forearm protection adjustable in length, whose angle to the grip is adjustable. Apart from ergonomical points of view also hygienical considerations are in favor of exchangeability of the parts coming into contact with the user.

For transportation of the walking aids it is preferable if they are stackable or if the forearm supports are detachable or can be folded down. Upon removal of the forearm supports the walking aid can also be used as walking stick.

Furthermore, a two-piece construction is advantageous, the forearm region as well as the grip being integrally formed of plastic material. This device is mounted on the walking tube adjustable in height.

Two angles will result from the construction, one of which angles describes the position of the forearm part with respect to the grip, whereas the second angle results from the mounting of the grip to the vertical support tube. It has been proved to be ergonomically preferable if the angle between the grip and the rod-shaped part lies within a range of 60° to 80° and the angle between the grip and the forearm support lies within a range of 95° to 115°. This provides the advantage that on the one hand the arm bracket does not move away from the forearm during walking and on the other hand the gripping hand cannot slip on the grip, and is not moved forwardly in a lever-like manner. Deviations from these angles are possible and—if required—depend on the clinical nature of the patient (e.g. rheumatism). In such cases an individual inclination of angles generally is possible.

The shape of the walking aid in accordance with the present invention permits use thereof as a grapnel, too. It can be hung onto tables, stools, cupboards or also over the bent forearm, as is required for mounting stairs e.g., for being able to get hold of the banisters with the hand left unoccupied. The walking aid in accordance with the present invention serves as an absolutely safe hold on a common wardrobe with double doors in particular when suspending the aid on the top ridge thereof, so that the second walking aid can be hung to the key or a button of a wardrobe door. Secured in such way, a patient may bend into the wardrobe and serve himself. When closing the wardrobe, one walking aid is located on the wardrobe key or door knob, respectively, ready to be gripped so that the patient supported with said aid can slide down the walking aid hung on the wardrobe ridge. Patients with hip, back and rheumatism complaints would otherwise need a nurse for coping with dressing, as when using common walking aids in particular opened wardrobe doors do not permit securing of the body nor placing of the walking aids, ready for gripping. The same is true for activities in the bathroom and in the kitchen, the walking aid being hung onto the washbasin, the radiators or a window etc.

The grip consisting of blunt plastic material as well as the crutch capsule also being blunt on its bottom end prevent slipping of the suspended walking aid as well as damages to the furniture or objects which it is hung about.

The walking cap, the so-called crutch capsule, preferably is made from hard rubber or an equivalent synthetic material. Its large-area walking region having a diameter of about 4.5 cm in resting position increases when loaded depending on the body weight. This offers the advantage as compared to traditional crutch capsules that slipping is safely avoided also when walking on marble or parquet floor. The patient, moreover, with his walking aid moves without vibrations and thus without pain after an operation or in case of rheumatism in the sense of a rolling-on foot.

The shape of the walking aid in accordance with the present invention renders it stackable. Whereas traditional walking aids slip due to their construction, cannot be assembled slenderly in particular, the shape of the walking aid in accordance with the present invention is designed for being stacked. This permits down a pair of walking aids ready for gripping in the car on the transmission tunnel. For longer storage periods the walking aids can be connected with one another using a small belt, a sponge or a clip, so that mislaying of one single walking aid is avoided. Such stackability furthermore includes advantages for their transportation, e.g. also in an airplane as well as room-saving mass delivery into critical regions.

Further scope of applicabilty of the present invention will become apparent from the detailed description given hereinafter. However, it should be understood that the detailed description and specific examples, while indicating preferred embodiment of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
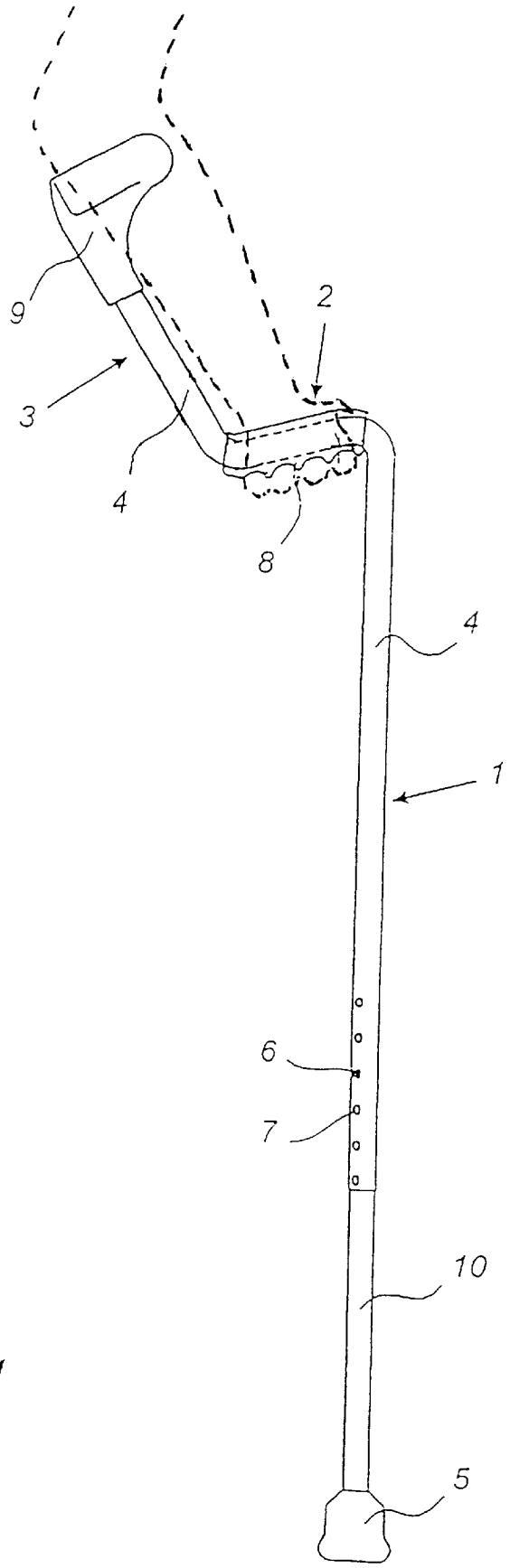
FIG. 1 shows an embodiment of the walking aid in accordance with the present invention.

FIG. 1 shows a walking aid having a rod-shaped part 1, a grip 2 and a forearm support 3 or a forearm region, respectively. The grip 2 and said forearm support 3 and/or the forearm region, respectively, form a continuous tube 4 made from an aluminum alloy. The angle between said rod-shaped part 1 and said grip 2 is to 70° and the angle between said grip 2 and said forearm support 3 is 105°.

Said rod-shaped part 1 is adjustable in length by means of holes 7 arranged in one row and snap-on means 6 provided in said tube. Said snap-on means 6 therein is provided on an inner tube 10 which can be shifted within said tube 4 with respect to the tube axis. A rubber foot 5 is slid onto the end of said inner tube 10. The diameter on the bottom side of said rubber foot 5 is more than twice the diameter of said inside tube 10. The rim the bottom side of said rubber foot 5 is designed such that rolling-on of the walking aid about the point of contact is rendered possible. An antiskid profile is located on the bottom side of said rubber foot 5. Furthermore, a rear light (not shown) flashing upon positioning of the walking aid onto the floor is arranged on the rear side of the walking aid. A reception (not shown) for a battery is also provided in the rubber foot 5.

The grip 2 comprises a resilient material 8 applied on said tube 4. Said resilient material 8 formed of a cellular rubber has recessed grips on its bottom side. For exchanging the resilient material 8 a slot is provided for which is glued together for use of the walking aid. It also is possible to slide the resilient material 8 onto the continuous tube 4.

The forearm support 3 on its end has a guide arm 9 consisting of synthetic material. Said guide arm 9 is slid onto said continuous tube 4 and therefore is exchangeable.

Figure 2:
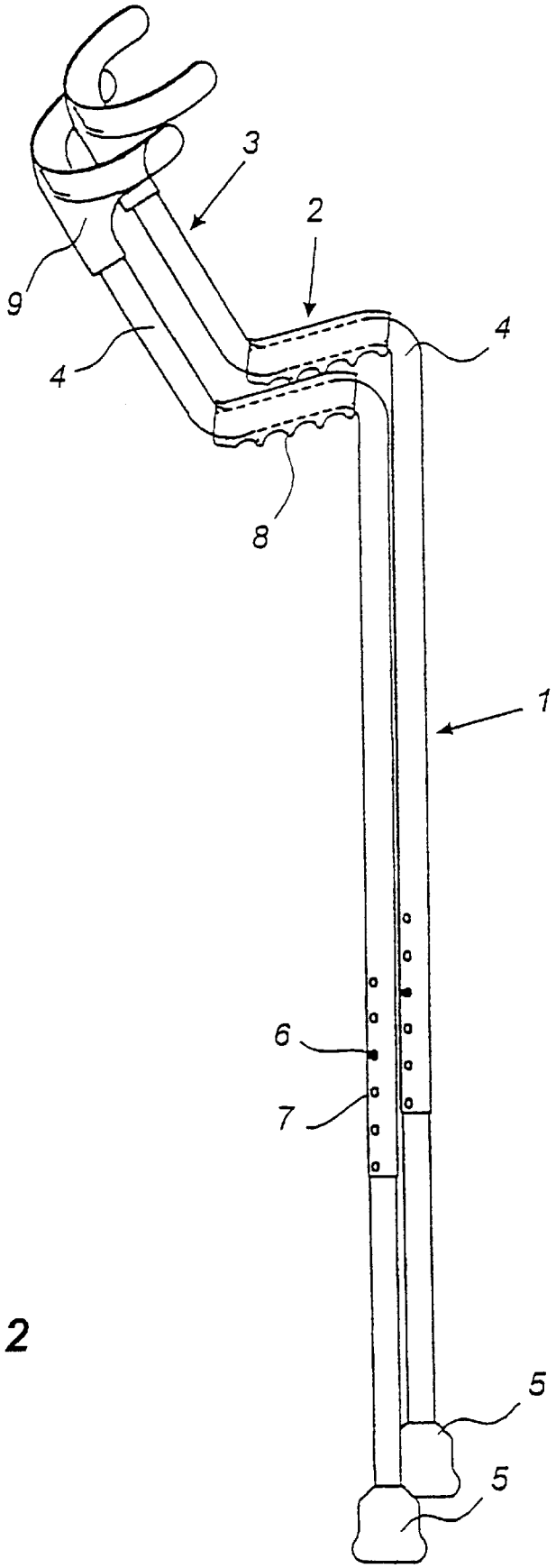
FIG. 2 shows two walking aids of FIG. 1, one stacked on the other.

As can be seen from FIG. 2, the walking aids can be stacked one on top of the other due to the design of the aids. For this purpose each forearm bracket 9 of the lower walking aid respectively grips into the forearm bracket 9 of the walking aid on top thereof. In stacked position the resilient material 8 of the grips 2 and eventually the two rubber feet 5 bear on one another so that damaging of the walking aids can be prevented.

In a further embodiment (not shown) of the present invention the tube is made from synthetic material and on its one end ends in the grip. The forearm support is formed by a further plastic tube having an integrated forearm bracket. The forearm support therein is shiftable into the tube of the grip. In inserted position the angle between the grip and the forearm support can be adjusted by suitable means. It also is possible to completely fold the forearm support in downward direction. On the rear side of the forearm support or the forearm region, respectively, reflectors for better noticeability of the walking aids are arranged.

What is claimed is:

1. A walking aid or crutch comprising:

a vertical rod-shaped part;

a slanting grip connected to a first end of said rod-shaped part at a first end thereof; and a forearm support connected to a second end of said grip by a first end thereof, said grip being connected to said rod-shaped part forming an angle therebetween of between 60° and 80°, said forearm support being connected to said grip forming an angle therebetween of between 95° and 115°.

2. The walking aid as defined in claim 1 wherein said rod-shaped part (1), said grip (2) and said forearm support are formed from a continuous tube (4).

3. The walking aid as defined in claim 2, wherein said continuous tube (4) is made from an aluminum alloy.

4. The walking aid as defined in claim 2, wherein said continuous tube (4) is made from plastic material.

5. The walking aid as defined in claim 1, wherein said grip (2) extends away from said rod-shaped part in a first direction and said forearm support (3) extends further in said first direction than said grip extends in the first direction.

6. The walking aid as defined in claim 5, wherein said rod-shaped part, said grip and said forearm support are generally straight members.

7. The walking aid as defined in claim 6, wherein a guide arm is connected to a second end of said forearm support, at least a portion of said guide arm extending further in said first direction than said forearm support.

8. The walking aid as defined in claim 1, wherein said rod-shaped part (1) comprises a rubber foot (5) on a second end thereof.

9. The walking aid as defined in claim 8, wherein the diameter of said rubber foot (5) is greater than the diameter of said rod-shaped part (1) and said rubber foot (5) has a rim rounded to a top thereof.

10. The walking aid as defined in claim 9, wherein said rubber foot (5) has a profile on a bottom side thereof.

11. The walking aid as defined in claim 1, wherein said rod-shaped part (1) is adjustable in length.

12. The walking aid as defined in claim 1, wherein said grip (2) has a resilient material (8) thereon.

13. The walking aid as defined in claim 12, wherein said resilient material (8) is exchangeable.

14. The walking aid as defined in claim 12, wherein said resilient material (8) is arranged around said continuous tube (4).

15. The walking aid as defined in claim 1, wherein said forearm support (3) is provided with a fork-shaped forearm bracket (9) on a second end thereof such that the walking aid is secured against sliding when in stacked condition with another walking aid by mutual engagement of the forearm brackets (9).

16. The walking aid as defined in claim 1, wherein a guide arm is connected to a second end of said forearm support, said guide arm including an end which is fork-shaped.

17. A walking aid or crutch comprising:

a vertical rod-shaped part;

a slanting grip connected to a first end of said rod-shaped part at a first end thereof; and a forearm support connected to a second end of said grip by a first end thereof, said grip being connected to said rod-shaped part forming an angle therebetween of between 60° and 80°, said forearm support being connected to said grip forming an angle therebetween of between 95° and 115°, and wherein said grip extends away from said rod-shaped part in a first direction and said forearm support extends away from said rod-shaped part in said first direction further than said grip extends in said first direction.

18. The walking aid as defined in claim 17, wherein said rod-shaped part, said grip and said forearm support are generally straight members.

19. The walking aid as defined in claim 18, wherein a guide arm is connected to a second end of said forearm support, at least a portion of said guide arm extending further in said first direction than said forearm support.

* * * * *